United States Patent [19]

Smithson

[11] Patent Number: 5,008,981

[45] Date of Patent: Apr. 23, 1991

[54] ENCLOSED YOKE CLASP FOR BOLA-STYLE NECKTIE

[76] Inventor: Joseph P. Smithson, 4020 Douglas St., Farmington, N. Mex. 87401

[21] Appl. No.: 444,758

[22] Filed: Dec. 1, 1989

[51] Int. Cl.[5] ..... A41D 25/04

[52] U.S. Cl. ..... 24/49 R; 24/115 G; 24/136 R

[58] Field of Search ..... 24/49 R, 49 S, 115 G, 24/135 N, 136 R, 136 K

[56] References Cited

U.S. PATENT DOCUMENTS

| | | | |
|---|---|---|---|
| 297,071 | 4/1884 | Doremus | 24/136 R |
| 399,027 | 3/1889 | Frank . | |
| 528,455 | 10/1894 | Zeller . | |
| 860,189 | 7/1907 | Chatfield . | |
| 865,531 | 9/1907 | Robinson . | |
| 1,068,139 | 7/1913 | Johnson . | |
| 1,080,013 | 12/1913 | Landin . | |
| 1,379,093 | 5/1921 | Freeberg | 24/115 G |
| 1,616,881 | 2/1927 | Wharton | 24/115 G |
| 1,639,278 | 7/1927 | Wharton et al. . | |
| 2,291,089 | 9/1942 | Okun . | |
| 2,573,806 | 11/1951 | Paterson | 24/136 R |
| 2,611,211 | 9/1952 | Stockton . | |
| 2,846,688 | 8/1958 | Meeker . | |
| 2,896,217 | 7/1959 | Cedarstaff | 24/49 S X |
| 3,675,277 | 7/1972 | Day . | |
| 3,965,544 | 6/1976 | Boden . | |

FOREIGN PATENT DOCUMENTS

| | | | |
|---|---|---|---|
| 67270 | 1/1944 | Norway . | |
| 46651 | 2/1919 | Sweden . | |
| 769646 | 3/1957 | United Kingdom | 24/115 G |

OTHER PUBLICATIONS

Excerpts "Bola Tie—New Symbol of the West", William J. Kramer, ©1978 Northland Press, Flagstaff, Arizona.

*Primary Examiner*—Laurie K. Cranmer
*Attorney, Agent, or Firm*—Kenton L. Freudenberg; Maxwell C. Freudenberg

[57] ABSTRACT

A clasp for the cords of a bola tie comprising two mating shell halves and a manually operable spring biased clamp disposed between the shell halves to provide an enclosed clasp which is releasable and which provides improved external appearance and mechanical function. The inner surfaces of the clasp which engage the tie ends are smooth non-abrading convex portions of toroidal-like surfaces and clasp the tie ends around an extensive part of the periphery of the cord and along extended portions of the cord. Although firmly clasping the cord ends the clasp may be forced along the cord ends without manually releasing the clamp.

4 Claims, 2 Drawing Sheets

ENCLOSED YOKE CLASP FOR BOLA-STYLE NECKTIE

BACKGROUND OF THE INVENTION

Bola-style neckties have long been a commonly worn type of neckwear, particularly in the western United States. Such ties typically consist of a cord of 3/16 inch or smaller diameter worn around the neck, the free ends being held together by an clasp bearing some form of ornamentation such as precious stones. Clasps traditionally used for bola style type ties have been non-releasable devices which slide upon the cords comprising the tie and which rely on friction to maintain their position. Examples of this type of clasp are seen in U.S. Pat. No. 2,846,688 to Meeker and 2,896,217 to Cedarstaff. Because of the constant friction on the tie such clasps are inconvenient to operate and create substantial wear on the tie through use over a period of time.

An example of a releasable prior art bola tie clasp is shown in U.S. Pat. No. 3,675,277 to Day. Such prior art clasp had a number of disadvantages. First the clasp requires the addition of a stone or other ornamentation (column 2, line 36–39) or other ornamentation to form a completed article of jewelry. Second the clasp is constructed of parts which are separable from one another and requires the cords of a bola tie to be in place to hold the various components together. Third, even with its releasable feature, it does not provide the smooth sliding and clamping surfaces of the present invention which minimize wear on the cords of a bola tie during continued normal use.

SUMMARY OF THE INVENTION

The present invention is intended to overcome the limitations of the earlier non-releasable bola clasps as well as prior art releasable clasps as represented by Day. The present invention provides an enclosed spring-biased mechanical clasp which can be completely released manually to slide freely upon a bola tie. The enclosed shell provides a "clean," aesthetically pleasing appearance and can be constructed of various precious metals to create a functional article of jewelry without need for the attachment of additional external ornamentation. The releasable clasping function is performed by a clamp member with a generally conical or toroidal surface, movable along its axis and perpendicular to the axes of the cords to be clasped. The surface of this conical or toroidal member in contact with the cords of the tie is provided with an arcuate cross section which fits closely with the curved external surface of the round cords. By having only continuous smooth or rounded surfaces in clamping contact with the cords of the bola tie, the tie is subject to very little abrasive action, resulting in less wear on the tie and smoother and easier operation of the clasp as it is moved upon the cords when the tie is being tightened or loosened. Further, because of the smooth interior surface of the present invention, assembly of the clasp onto the cords of a bola tie is easily accomplished by simply manually releasing the clamping mechanism and sliding the cords through from the upper entrance apertures in the casing of the clasp to exit through a common lower exit aperture in the casing. While the present clasp is intended to hold the cords of a bola tie sufficiently securely, the clamping function is not secure enough to "lock" the clasp in place, thereby allowing the clasp to slide if the cord loop around the neck of the wearer is subjected to a force which might be dangerous to the wearer.

It is an object of the invention to provide a clasp for a bola tie which minimizes abrasion and wear on the cords of the tie as the clasp is moved when fastening and unfastening the tie.

It is also an object of the present invention to provide a releasable bola tie clasp of improved mechanical function.

It is another object of the present invention to provide a releasable bola tie clasp which provides a simplified structure with a releasable mechanical clasping function but which requires no addition of external ornamentation to be used in an ornamental fashion.

It is a further object of the present invention to provide a releasable bola tie clasp of integral design with a minimum number of separate parts which remain assembled upon removal from the cords of a bola tie.

It is another object of the present invention to provide a clasp for a bola tie with a releasable fastening means which is secure enough to serve as a tie clasp but which will release or slide if the tie is caught or subjected to a significant force to prevent any danger of a tie being excessively tightened or caught around the wearer's neck.

DESCRIPTION OF THE PREFERRED EMBODIMENT

As used in this specification all descriptive terms relating to spatial orientation refer to the orientation of the clasp as it would normally be worn by a person wherein the ends of the cord of the bola tie enter and leave the clasp at upper and lower sides of the clasp respectively and wherein the free ends of the bola tie hang vertically downward from the clasp. The clasp itself is generally positioned just below the front of the wearer's neck. While a Bola tie comprises a single cord which passes around a wearer's neck with the ends secured together by a clasp, within this specification each cord end may be referred to as an individual cord and the two cord ends referred to as "cords."

Figure 1:
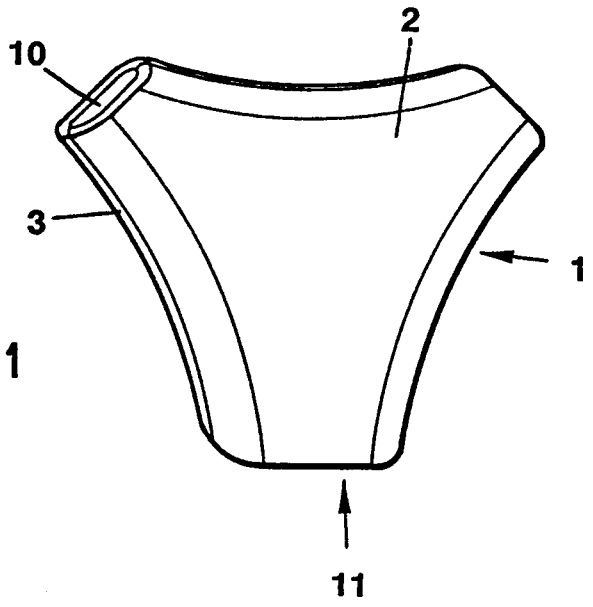
FIG. 1 is a perspective view showing the exterior of the bola clasp of the preferred embodiment from the front.
Figure 2:
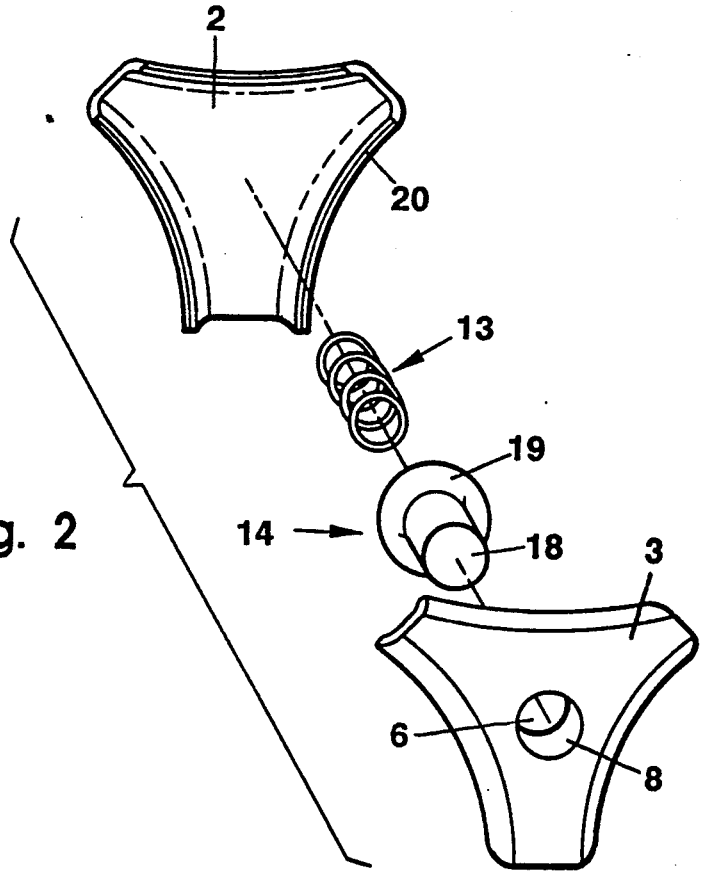
FIG. 2 is an exploded perspective view showing the components of the bola clasp of the preferred embodiment from the rear.

As shown in FIG. 1 the bola clasp of the preferred embodiment comprises a hollow enclosed shell 1 of generally triangular shape symmetrical about a vertical front to rear plane and made from front and rear shell halves 2 and 3 respectively. Because the clasp is worn as an article of apparel and intended to be ornamental, the shell halves are cast or stamped out of silver or other precious metal and their exterior surfaces may be engraved or otherwise embellished with ornamental designs. The thin front and rear walls of the clasp formed by the thin-walled shell halves 2 and 3 make up only a relatively small portion of the thickness of the clasp, thus providing the hollow space within the shell. Each end of the cord 5 of a bola tie enters the clasp through an entrance aperture 10 at one of two upper vertices or corners of the triangular shape. Both cord ends exit the shell through a common exit opening 11 located at the third and lower vertex or corner of the triangular shape. An alternative embodiment, is provided with one upper entrance opening and one lower exit opening with both openings being located upon the vertical axis of the clasp. In such embodiment the cords remain generally vertical, side by side and parallel to one another, being separated only by the clamp portions within the shell.

Figure 4:
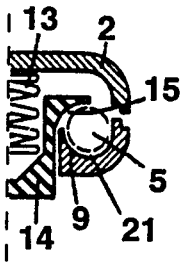
FIG. 4 is a partial cross sectional view taken at B-B of FIG. 3 showing the clamp member in its clamped position illustrating the clamp action of the clamp member.
Figure 6:
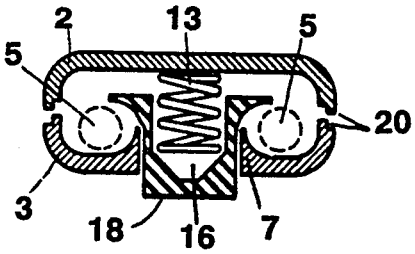
FIG. 6 is a cross sectional view taken at A-A of FIG. 3 showing the clamp member in its clamped position.
Figure 7:
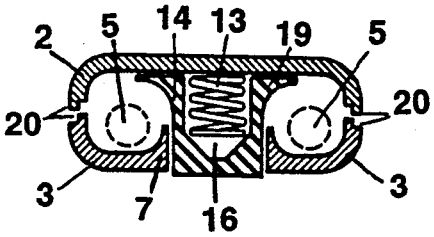
FIG. 7 is a cross sectional view taken at A—A of FIG. 3 showing the clamp member in its released configuration.

As seen most clearly in FIG. 7, the mating edges of the shell halves are provided with overlapping or interfitting lips 20 to facilitate the alignment of the shell halves during the assembly process. The slight gap seen between the mating edges in those figures is for illustrative purposes and is shown only to clarify the detail of the edges. By constructing the shell halves of silver they may be permanently fastened together by soldering their mating edges around their periphery i.e., along the three arcuate sides of the shell which extend between the three vertices of the triangular shell. Alternatively shell halves 2 and 3 may be machined or stamped from any suitable metal, or may by molded from plastic or composite material, and secured or bonded together with suitable adhesive or by solvent bonding, or provided with overlapping interfitting edges which may be securely snapped together or held together with a force fit. The rear shell half 3 is provided with a circular aperture or opening 6 through which a portion of the clamp member 14 passes to provide an external manually operable "pushbutton" surface 18 for release of the device. As seen in FIGS. 6 and 7, the shell is thickened in the area surrounding the aperture to provide an integral raised lip portion 7 on the inner surface of shell half which gives the cylindrical inner surface of the aperture a greater depth to provide a bearing surface 8 extending axially along the clamp member to facilitate guiding it as it slides within the aperture. As seen in FIG. 4, the side surface of the raised lip structure 7 opposite or away from the aperture has an arcuate cross section 9 to provide part of a channel shaped seat for the cord with a generally semi-circular cross sectional shape corresponding to the shape of the exterior of the cord.

Figure 5:
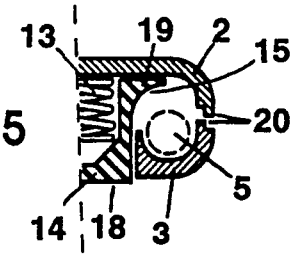
FIG. 5 is a partial cross sectional view taken at B-B of FIG. 3 showing the clamp member in its released configuration.

The clamp member 14 is generally thimble shaped with an open end and a closed end and is molded, machined or cast from any suitable material such as brass. At the closed end the member is cylindrical. The clamp member 14 has an inner cylindrical wall which positions and confines the coil spring with one end in the actuating portion of the clamp member and the other end against the front shell half 2. The open end of the clamp member is splayed outward to form a wide lip 19 with a toroidal shape, i.e. a portion of a toroid. This toroidal surface provides a cord tie clamping surface. The outward flare of the open end prevents the clamp member 14 from passing through the aperture 6 in the rear shell half, and thereby retains the clamp member within the shell when the clasp is not in place on a bola tie. The recess 16 in the open end of the clamp member receives one end of coil spring 13, the opposite end of which is seated against the front shell half 2. The spring 13, acting in compression, thereby biases the clamp member 14 to its clamped position shown in FIGS. 4 and 6. The clamp member is movable along its own axis and perpendicular to the vertical plane defined by the mating surfaces of the shell halves. The splayed exterior clamping surface 19 of the clamp member is of generally arcuate cross section 15 with a radius corresponding to the size of the cords upon which the clasp will be used. This provides a smooth extended surface of contact with the cord rather than a single point of contact. The closed end of the clamp member provides a manually engageable external surface 18 or "button." Manually pushing against this surface moves the clamp member along its axis and against the biasing spring 13 to its released position as shown in FIGS. 5 and 7 wherein the splayed end of the thimble-shaped clamp member 14 abuts the inner face of the front shell half 2 and the spring 13 is located completely within the clamp member 14.

Figure 3:
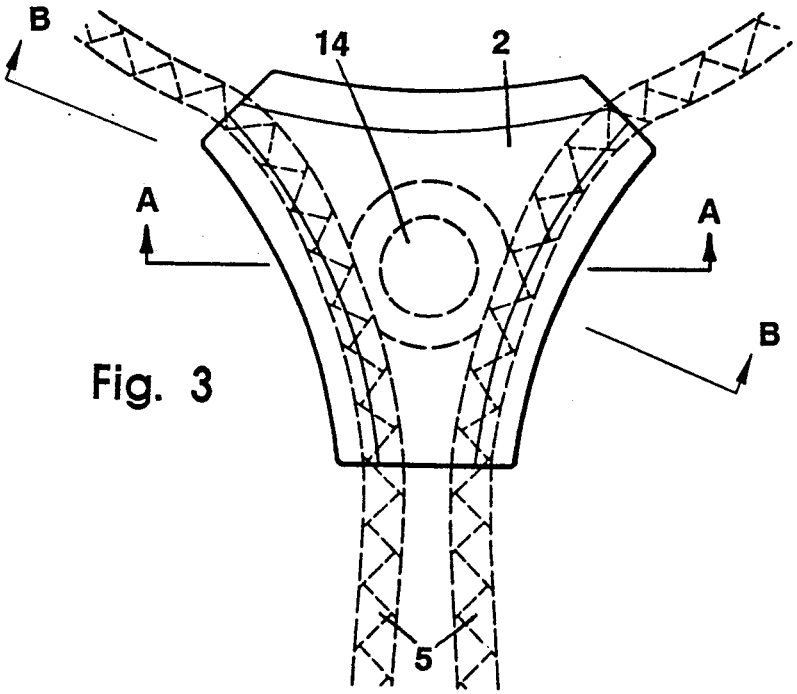
FIG. 3 is a plan view of the bola clasp of the preferred embodiment from the front showing a bola tie in place.

As seen in FIG. 4 a portion of the rear shell half has forwardly facing concave channels 21 having semi-circular cross section through which the cords 5 pass and within which the cords are held by the overlying splayed lip portion 19 of the clamp member. This lip portion 19 has a cross section as seen in FIG. 4 which encircles each of the cord ends over the arcuate extent 15 of approximately 90 degrees. Thus the smooth walls of the concave channels 21 in the rear shell half 3 and the splayed lip portion 19 wrap approximately 270 degrees around the respective cords 5 along a short length of each of the cords. As seen in FIG. 3, the bola cords curve upwardly and outwardly within the shell halves 2 and 3 along the inner smooth arcuate walls of the shell at both sides of the short lengths of the cords which are clamped by the clamp member 14. While FIG. 4. shows a partial cross sectional area representing approximately one-half of the cross sectional area of the full clasp and shows only one of the two cords, a corresponding portion of the remaining half would be represented by a mirror image of FIG. 4.

Other variations within the scope of this invention will be apparent from the described embodiment and it is intended that the present descriptions be illustrative of the inventive features encompassed by the appended claims.

What is claimed is:

1. A clasp for holding two cords in generally side-by-side relationship comprising: a hollow shell, a portion of said shell having an integral raised structure defining inside of said raised structure an inner surface forming a central annular opening in said shell portion and having on the outside of said raised structure away from said opening a pair of smooth-surfaced concave channels on opposite sides of the opening, a clamp member having a hollow manually engageable actuating portion extending through said opening, said clamp member having exterior smooth-surfaced splayed cord gripping portions overlying the concave channels, means including a compression spring having one end extending into the hollow actuating portion of the clamp member for resiliently biasing said clamp member to urge said splayed portions toward said channels to grip a cord in each of the channels, and means including a second shell portion overlying said first shell portion for securing both shell portions, said clamp member and said biasing means in an assembled relationship when no cords are in said channels, said shell portions being secured together at their periphery to form a hollow shell, said shell having apertures at the periphery of the shell portions where the cords can enter and leave the clasp, said apertures being located to permit alignment of the cords with said channels, said spring being located between said second shell portion and said clamp member.

2. A clasp according to claim 1 wherein said shell portions define a shell structure completely enclosing the cord gripping splayed portions and said channels and having external openings only where the cords enter and leave the clasp and where the actuating portion of the clamp member extends through the first-mentioned shell portion.

3. A clasp for holding two cords in generally side-by-side relationship comprising: first and second shell portions secured together to define a hollow enclosure within which the cords are held, said enclosure having apertures at opposite sides thereof for the two cords to enter and leave said enclosure, said first shell portion having an integral raised wall portion with one side defining an aperture located centrally thereof, a clamp member having a hollow manually engageable actuating portion extending externally of the enclosure through the aperture in the first shell portion, said clamp member being a thimble-shaped member having an open end whereat outwardly extending portions of the member define splayed cord engaging surfaces facing inner surfaces of said first shell portion to clasp portions of the cords therebetween with the clasped portions of the cords extending on opposite sides of the actuating portion of the clamp member and on the side of said wall portion opposite said aperture, and spring means for biasing said clamp member toward said first shell portion to provide a force for clasping the cords, said spring means comprising a compression spring extending between an inner face of the second shell portion and said clamping member and extending into the actuating portion of the clamp member, said hollow enclosure being generally triangular with entrance apertures for the respective cords at two corners of the enclosure and the third corner defines an aperture through which the cords leave the enclosure.

4. A clasp according to claim 3 wherein the two shell portions are secured together at their periphery to retain all parts of the clasp in their assembled relationship when there are no cord portions within the enclosure.

* * * * *